US008205467B2

(12) United States Patent
Setoguchi

(10) Patent No.: US 8,205,467 B2
(45) Date of Patent: Jun. 26, 2012

(54) AIR CONDITIONING APPARATUS

(75) Inventor: Takayuki Setoguchi, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 612 days.

(21) Appl. No.: 12/515,084

(22) PCT Filed: Nov. 20, 2007

(86) PCT No.: PCT/JP2007/072418
§ 371 (c)(1),
(2), (4) Date: May 15, 2009

(87) PCT Pub. No.: WO2008/062769
PCT Pub. Date: May 29, 2008

(65) Prior Publication Data

US 2011/0061413 A1 Mar. 17, 2011

(30) Foreign Application Priority Data

Nov. 21, 2006 (JP) ..... 2006-314493

(51) Int. Cl.
*F25B 13/00* (2006.01)
*F25B 27/00* (2006.01)
*F25B 1/00* (2006.01)

(52) U.S. Cl. ..... 62/324.1; 62/324.6; 62/498

(58) Field of Classification Search ..... 62/238.7, 62/498, 324.1, 324.6, 335, 160
See application file for complete search history.

(56) References Cited

U.S. PATENT DOCUMENTS

| | | | |
|---|---|---|---|
| 4,104,890 | A | 8/1978 | Iwasaki |
| 5,906,107 | A | 5/1999 | Takahashi et al. |

FOREIGN PATENT DOCUMENTS

| | | | |
|---|---|---|---|
| JP | 11-118275 | A | 4/1999 |
| JP | 2001-056156 | A | 2/2001 |
| JP | 2002-228297 | A | 8/2002 |
| JP | 2004-353995 | A | 12/2004 |
| JP | 2005-98607 | A | 4/2005 |
| JP | 2006-336971 | A | 12/2006 |
| KR | 10-1998-0069773 | A | 10/1998 |

OTHER PUBLICATIONS

Korean Office Action of corresponding Korean Patent Application No. 10-2009-7010332 dated Mar. 11, 2011.
Office Action of corresponding Chinese Application No. 200780042801.2 dated Sep. 10, 2010.
Notice of Allowance of corresponding Japanese Application No. 2006-314493 dated Feb. 14, 2012.

*Primary Examiner* — Chen Wen Jiang
(74) *Attorney, Agent, or Firm* — Global IP Counselors

(57) ABSTRACT

An air conditioning apparatus includes a heat source unit, a first utilization unit, a second utilization unit, a refrigerant communication pipe and a control section. The heat source unit includes a heat source side compressor, a heat source side heat exchanger and a heat source side expansion mechanism. The first utilization unit includes a first utilization side compressor, a first utilization side heat exchanger and a first utilization side expansion mechanism. The second utilization unit includes a second utilization side compressor, a second utilization side heat exchanger and a second utilization side expansion mechanism. The control section is configured to control the first utilization side compressor and the first utilization side expansion mechanism in accordance with operation load of the first utilization unit, and to control the second utilization side compressor and the second utilization side expansion mechanism in accordance with operation load of the second utilization unit.

8 Claims, 5 Drawing Sheets

AIR CONDITIONING APPARATUS

CROSS-REFERENCE TO RELATED APPLICATIONS

This U.S. National stage application claims priority under 35 U.S.C. §119(a) to Japanese Patent Application Nos. 2006-314493, filed in Japan on Nov. 21, 2006, the entire contents of which are hereby incorporated herein by reference.

TECHNICAL FIELD

The present invention relates to a multi-type air conditioning apparatus in which a plurality of indoor units are connected to an outdoor unit.

BACKGROUND ART

The so-called multi-type air conditioning apparatus has conventionally been produced. In the multi-type air conditioning apparatus, a plurality of indoor units are connected to single outdoor unit. For example, this is described in Japanese Laid-open Patent Application No. JP-H11-118275. In the multi-type air conditioning apparatus, it is possible to arbitrarily combine a plurality of indoor units having different operation capacities depending on usage types of structures (e.g., buildings). Accordingly, the multi-type air conditioning apparatus is capable of individually conducting air conditioning on a floor-to-floor basis and a space-to-space basis. In other words, it is possible to arbitrarily combine a plurality of indoor units depending on operation loads to be applied in cooling and heating of the respective indoor spaces. Consequently, the multi-type air conditioning apparatus is capable of conducting air conditioning without consuming unnecessary energy.

SUMMARY OF THE INVENTION

Technical Problem

However, the aforementioned multi-type air conditioning apparatus is not capable of accurately changing evaporation temperature or condensation temperature in each indoor unit. Because of this, for instance, when the multi-type air conditioning apparatus simultaneously includes a type of indoor unit configured to be operated with operation capacity approximately the same as the maximum capacity and a type of indoor unit configured to be operated with operation capacity less than the maximum capacity, the latter indoor unit is required to set degree of superheating of an outlet of an evaporator to be large in a cooling operation. Furthermore, the latter indoor unit is required to set degree of subcooling of a condenser to be large in a heating operation. Accordingly, operational efficiency of the multi-type air conditioning apparatus may be worse.

An object of the present invention is to provide a multi-type air conditioning apparatus capable of controlling necessary operation capacities of a plurality of indoor units in accordance with their operation loads, respectively.

Solution to Problem

An air conditioning apparatus according to a first aspect of the present invention is an air conditioning apparatus configured to conduct air conditioning by changing a state of refrigerant. The air conditioning apparatus includes a heat source unit, a first utilization unit, a second utilization unit, a refrigerant communication pipe and a control section. The heat source unit includes a heat source side compressor, a heat source side heat exchanger and a heat source side expansion mechanism. The heat source side compressor is configured to compress the refrigerant. The heat source side heat exchanger is configured to conduct heat exchange of the refrigerant. The heat source side expansion mechanism is configured to decompress the refrigerant. The first utilization unit includes a first utilization side compressor, a first utilization side heat exchanger and a first utilization side expansion mechanism. The first utilization side compressor is configured to compress the refrigerant. The first utilization side heat exchanger is configured to conducting heat exchange of the refrigerant. The first utilization side expansion mechanism is configured to decompress the refrigerant. The second utilization unit includes a second utilization side compressor, a second utilization side heat exchanger, and a second utilization side expansion mechanism. The second utilization side compressor is configured to compress the refrigerant. The second utilization side heat exchanger is configured to conduct heat exchange of the refrigerant. The second utilization side expansion mechanism is configured to decompress the refrigerant. The refrigerant communication pipe connects the heat source unit and both the first and second utilization units. The control section is configured to control the first utilization side compressor and the first utilization side expansion mechanism in accordance with operation load of the first utilization unit and control the second utilization side compressor and the second utilization side expansion mechanism in accordance with operation load of the second utilization unit.

According to the first aspect of the present invention, a plurality of utilization units (i.e., the first and second utilization units) are provided, and not only the heat source unit but also each of the first and second utilization units is provided with the first utilization side compressor and the second utilization side compressor. Furthermore, the control section is configured to control the first utilization side compressor and the first utilization side expansion mechanism in accordance with operation load of the first utilization unit and control the second utilization side compressor and the second utilization side expansion mechanism in accordance with operation load of the second utilization unit.

With the structure, for instance, each of the utilization units is allowed to independently control evaporation temperature of the refrigerant in a cooling operation and high pressure of refrigerant in a heating operation. Accordingly, the air conditioning apparatus is capable of accurately controlling operation capacity of each utilization unit depending on its operation load. Consequently, the air conditioning apparatus is capable of enhancing its operation efficiency and saving energy.

An air conditioning apparatus according to a second aspect of the present invention is the air conditioning apparatus according to the first aspect of the present invention, wherein the first utilization side compressor and the second utilization side compressor are allowed to be controlled by an inverter.

According to the second aspect of the present invention, the first utilization side compressor and the second utilization side compressor are capacity variable compressors, and are allowed to be controlled by an inverter. With the structure, the air conditioning apparatus is capable of controlling capacity of the first utilization side compressor for allowing the first utilization side compressor to operate with operation capacity depending on operation load of the first utilization unit. Furthermore, the air conditioning apparatus is capable of controlling capacity of the second utilization side compressor for allowing the second utilization side compressor to operate with operation capacity depending on operation load of the second utilization unit.

An air conditioning apparatus according to a third aspect of the present invention is the air conditioning apparatus according to the first aspect or the second aspect of the present invention, wherein the heat source unit further includes an intermediate cooler.

According to the third aspect of the present invention, the heat source unit is provided with the intermediate cooler for cooling liquid refrigerant of intermediate pressure and gas refrigerant of intermediate pressure. Gas-liquid two-phase state refrigerant, expanded to the intermediate pressure by the higher-stage expansion mechanism, and gas refrigerant, compressed to the intermediate pressure by the lower-stage compressor, pass through the intermediate cooler. In this case, part of the liquid refrigerant is evaporated, and accordingly a refrigeration effect is provided for the refrigerant in the intermediate cooler.

With the structure, it is possible to cool the intermediate-pressure gas refrigerant compressed by the lower-stage compressor to exactly or approximately the saturated state. Additionally, it is similarly possible to cool the liquid refrigerant to the subcooling zone by means of the refrigeration effect. Therefore, it is possible to enhance the refrigeration effect. Furthermore, it is possible to reduce discharge temperature of the higher-stage compressor. Accordingly, it is possible to prevent deterioration of lubricant oil of the higher-stage compressor.

An air conditioning apparatus according to a fourth aspect of the present invention is the air conditioning apparatus according to any of the first to third aspects of the present invention, wherein the heat source unit further includes a heat source side switch mechanism. The heat source side switch mechanism is capable of switching between a first condition and a second condition. The first condition is a condition for causing the refrigerant compressed to intermediate pressure by the first utilization side compressor or the second utilization side compressor to flow into the heat source side compressor, and for causing the refrigerant compressed to high pressure by the heat source side compressor to flow into the heat source side heat exchanger. The second condition is a condition for causing the low-pressure refrigerant evaporated by the heat source side heat exchanger to flow into the heat source side compressor, and for causing the refrigerant compressed to the intermediate pressure by the heat source side compressor to flow into the first utilization side compressor or the second utilization side compressor. The first utilization unit further includes a first utilization side switch mechanism. The first utilization side switch mechanism is capable of switching between a third condition and a fourth condition. The third condition is a condition for causing the low-pressure refrigerant evaporated by the first utilization side heat exchanger to flow into the first utilization side compressor, and for causing the refrigerant compressed to the intermediate pressure by the first utilization side compressor to flow into the heat source side compressor. The fourth condition is a condition for causing the refrigerant compressed to the intermediate pressure by the heat source side compressor to flow into the first utilization side compressor, and for causing the refrigerant compressed to the high pressure by the first utilization side compressor to flow into the first utilization side heat exchanger. The second utilization unit further includes a second utilization side switch mechanism. The second utilization side switch mechanism is capable of switching between a fifth condition and a sixth condition. The fifth condition is a condition for causing the low-pressure refrigerant evaporated by the second utilization side heat exchanger to flow into the second utilization side compressor, and for causing the refrigerant compressed to the intermediate pressure by the second utilization side compressor to flow into the heat source side compressor. The sixth condition is a condition for causing the refrigerant compressed to the intermediate pressure by the heat source side compressor to flow into the second utilization side compressor, and for causing the refrigerant compressed to the high pressure by the second utilization side compressor to flow into the first utilization side heat exchanger. The control section is configured to conduct first control and second control. The first control is control for setting the heat source side switch mechanism, the first utilization side switch mechanism and the second utilization side switch mechanism to be in the first condition, the third condition and the fifth condition, respectively. The second control is control for setting the heat source side switch mechanism, the first utilization side switch mechanism and the second utilization side switch mechanism to be in the second condition, the fourth condition and the sixth condition, respectively.

According to the fourth aspect of the present invention, each of the heat source unit, the first utilization unit and the second utilization unit is provided with a switch mechanism (e.g., four-way switch valve) for switching operational conditions (e.g., a heating operation and a cooling operation) back and forth, for instance.

With the structure, it is possible to switch to use the first utilization side heat exchanger and the second utilization side heat exchanger as gas coolers and use the heat source side heat exchanger as an evaporator. Contrary to this, it is also possible to switch to use the first utilization side heat exchanger and the second utilization side heat exchanger as evaporators and use the heat source side heat exchanger as a gas cooler. Accordingly, it is possible to switch operational conditions of the utilization units between the cooling operation and the heating operation. Thus, it is possible to switch the operational conditions depending on temperature. Consequently, the air conditioning apparatus is capable of providing comfortable air-conditioned space.

Advantageous Effects of Invention

According to the air conditioning apparatus of the first aspect of the present invention, each of the utilization units is allowed to independently control evaporation temperature of refrigerant in the cooling operation and high pressure of refrigerant in the heating operation. Accordingly, the air conditioning apparatus is capable of accurately controlling capacity of each utilization unit in accordance with its operation load, for instance. Consequently, the air conditioning apparatus is capable of enhancing its operational efficiency and saving energy.

According to the air conditioning apparatus of the second aspect of the present invention, the first utilization side compressor and the second utilization side compressor are capacity variable compressors, and are allowed to be controlled by an inverter. Accordingly, the air conditioning apparatus is capable of controlling capacity of the first utilization side compressor for allowing the first utilization side compressor to operate with operation capacity depending on operation load of the first utilization unit. Furthermore, the air conditioning apparatus is capable of controlling capacity of the second utilization side compressor for allowing the second utilization side compressor to operate with operation capacity depending on operation load of the second utilization unit.

According to the air conditioning apparatus of the third aspect of the present invention, it is possible to cool the intermediate-pressure gas refrigerant compressed by the lower-stage compressor to exactly or approximately the saturated state. Additionally, it is similarly possible to cool the liquid refrigerant to the subcooling zone by means of the refrigeration effect. Consequently, the air conditioning apparatus is capable of enhancing the refrigeration effect. Furthermore, it is capable of reducing discharge temperature of the higher-stage compressor. Accordingly, the air conditioning apparatus is capable of preventing deterioration of lubricant oil of the higher-stage compressor.

According to the air conditioning apparatus of the fourth aspect of the present invention, it is possible to switch usage of the first utilization side heat exchanger, the second utilization side heat exchanger and the heat source side heat exchanger. Specifically, it is possible to use the first utilization side heat exchanger and the second utilization side heat exchanger as gas coolers and use the heat source side heat exchanger as an evaporator. Contrary to this, it is also possible to use the first utilization side heat exchanger and the second utilization side heat exchanger as evaporators and use the heat source side heat exchanger as a gas cooler. Accordingly, it is possible to switch operational conditions of the utilization units between the cooling operation and the heating operation. In other words, the air conditioning apparatus is capable of switching operational conditions depending on temperature. Therefore, it is capable of providing a comfortable air-conditioned space.

DETAILED DESCRIPTION OF THE INVENTION

An air conditioning apparatus of an embodiment of the present invention will be hereinafter explained with reference to accompanying drawings.

<Configuration of Air Conditioning Apparatus>

Figure 1:
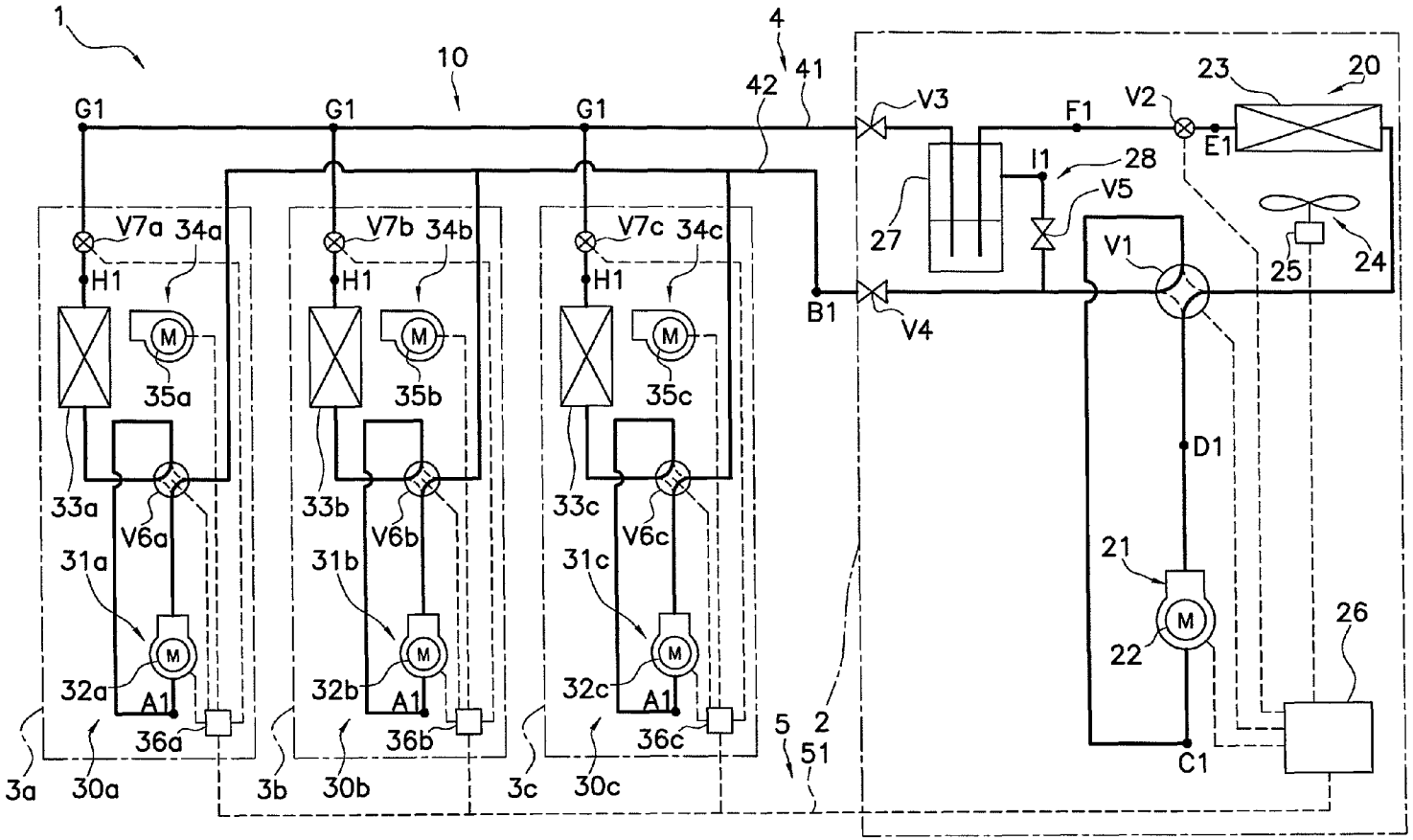
FIG. 1 is a refrigerant circuit diagram of an air conditioning apparatus according to an embodiment of the present invention.

FIG. 1 is a schematic configuration diagram of an air conditioning apparatus 1 according to an embodiment of the present invention. The air conditioning apparatus 1 includes two compressors and two expansion valves within a system of a refrigerant circuit 10 thereof. The air conditioning apparatus 1 is an apparatus to be used for conducting cooling and heating operations of the indoor of a building and the like by executing a two-stage compression two-stage expansion refrigeration cycle operation. The air conditioning apparatus 1 mainly includes an outdoor unit 2, indoor units 3*a* to 3*c*, and a refrigerant communication pipe 4. The outdoor unit 2 functions as a heat source unit. The indoor units 3*a* to 3*c* are connected to the outdoor unit 2, and function as utilization units. The refrigerant communication pipe 4 connects the outdoor unit 2 and the indoor units 3*a* to 3*c*. The refrigerant communication pipe 4 is composed of a liquid refrigerant communication pipe 41 and a gas refrigerant communication pipe 42. In other words, the refrigerant circuit 10 of the air conditioning apparatus 1 of the present embodiment is formed by the interconnection among the outdoor unit 2, the indoor units 3*a* to 3*c*, and the refrigerant communication pipe 4.

(1) Outdoor Unit

The outdoor unit 2 is disposed outside a building and the like. The outdoor unit 2 is connected to the indoor units 3*a* to 3*c* through the refrigerant communication pipe 4. The outdoor unit 2 forms a part of the refrigerant circuit 10.

Next, a configuration of the outdoor unit 2 will be explained. The outdoor unit 2 mainly includes an outdoor side refrigerant circuit 20. The outdoor side refrigerant circuit 20 forms a part of the refrigerant circuit 10. The outdoor side refrigerant circuit 20 mainly includes an outdoor compressor 21, an outdoor four-way switch valve V1, an outdoor heat exchanger 23 functioning as a heat source side heat exchanger, an outdoor expansion valve V2 functioning as an expansion mechanism, a gas liquid separator 27, a liquid side stop valve V3 and a gas side stop valve V4.

The outdoor compressor 21 is a compressor capable of changing its operation capacity. In the present embodiment, the outdoor compressor 21 is a positive-displacement compressor to be driven by a motor 22. Here, rotation speed of the motor 22 is controlled by an inverter. The outdoor compressor 21 functions as a compressor on the higher stage of the two-stage compression two-stage expansion refrigeration cycle in a cooling operation. It also functions as a compressor on the lower stage of the two-stage compression two-stage expansion refrigeration cycle in a heating operation. The two-stage compression two-stage expansion refrigeration cycle will be hereinafter explained. Note that only single outdoor compressor 21 is provided in the present embodiment. However, the number of the outdoor compressor 21 is not limited to this. For example, two or more compressors may be parallel-connected in accordance with the number of connected indoor units or the like.

The outdoor four-way switch valve V1 is a valve provided for causing the outdoor heat exchanger 23 to function as a condenser and an evaporator. The outdoor four-way switch valve V1 is connected to the outdoor heat exchanger 23, a suction side of the outdoor compressor 21, a discharge side of the outdoor compressor 21, and the gas refrigerant communication pipe 42. When the outdoor heat exchanger 23 is caused to function as a condenser, the outdoor four-way switch valve V1 is configured to connect the discharge side of the outdoor compressor 21 and the outdoor heat exchanger 23, and is also configured to connect the suction side of the outdoor compressor 21 and the gas refrigerant communication pipe 42 (see a solid-line condition in FIG. 1). On the other hand, when the outdoor heat exchanger 23 is caused to function as an evaporator, the outdoor four-way switch valve V1 is configured to connect the outdoor heat exchanger 23 and the suction side of the outdoor compressor 21, and is also configured to connect the discharge side of the outdoor compressor 21 and the gas refrigerant communication pipe 42 (see a dashed-line condition in FIG. 1).

The outdoor heat exchanger 23 is a heat exchanger allowed to function as a condenser and an evaporator. In the present embodiment, the outdoor heat exchanger 23 is a cross-fin typed fin-and-tube heat exchanger for conducting heat exchange between the refrigerant and air functioning as a heat source. One end of the outdoor heat exchanger 23 is connected to the outdoor four-way switch valve V1 while the other end thereof is connected to the liquid refrigerant communication pipe 41 via the outdoor expansion valve V2.

The outdoor expansion valve V2 is an electric expansion valve for regulating the pressure, the flow rate and the like of refrigerant flowing through the outdoor side refrigerant circuit 20. The outdoor expansion valve V2 is connected to the liquid side of the outdoor heat exchanger 23. The outdoor expansion valve V2 is configured to function as a first-stage expansion mechanism of the two-stage compression two-stage expansion refrigeration cycle in a cooling operation. On the other hand, the outdoor expansion valve V2 is configured to function as a second-stage expansion mechanism of the two-stage compression two-stage expansion refrigeration cycle in a heating operation. When the outdoor expansion valve V2 functions as the first-stage expansion mechanism, it decompresses the refrigerant of high pressure Ph to intermediate pressure Pm. On the other hand, when the outdoor expansion valve V2 functions as the second-stage expansion mechanism, it decompresses the refrigerant of the intermediate pressure Pm to low pressure Pl.

The gas liquid separator 27 is capable of storing liquid refrigerant by separating the gas-liquid two-phase state refrigerant into liquid refrigerant and gas refrigerant. Here, the gas-liquid two-phase state refrigerant flows into the gas liquid separator 27 after it is decompressed to the intermediate pressure Pm by the outdoor expansion valve V2 or an indoor expansion valve V7 (see the following description). The liquid refrigerant stored in the gas liquid separator 27 is transported to the indoor expansion valve V7 in the cooling operation whereas it is transported to the outdoor expansion valve V2 in the heating operation. Furthermore, the gas refrigerant separated from the gas-liquid two-phase state refrigerant by the gas liquid separator 27 is transported to a pipe between the gas side stop valve V4 and the outdoor four-way switch valve V1 through a bypass circuit 28. The bypass circuit 28 includes a bypass valve V5 capable of controlling the flow rate of the gas refrigerant.

Furthermore, the outdoor unit 2 includes an outdoor fan 24. The outdoor fan 24 functions as a ventilation fan for sucking outdoor air into the outdoor unit 2 and then discharging the sucked air to the outside after the outdoor heat exchanger 23 conducts heat exchange between the inhaled air and the refrigerant. The outdoor fan 24 is capable of changing the flow rate of air to be supplied to the outdoor heat exchanger 23. In the present embodiment, the outdoor fan 24 is a propeller fan to be driven by a motor 25, for instance. The motor 25 is composed of a DC fan motor.

Additionally, the outdoor unit 2 includes an outdoor side control unit 26. The outdoor side control unit 26 is configured to control operations of each of the elements forming the outdoor unit 2. The outdoor side control unit 26 includes a microcomputer, a memory, an inverter circuit and the like. The microcomputer is provided for controlling the outdoor unit 2. The inverter circuit is configured to control the motor 22 and the like. The outdoor side control unit 26 is capable of transmitting/receiving a control signal and the like to/from after-mentioned indoor side control units 36*a* to 36*c* of the indoor units 3*a* to 3*c* through a transmission line 51. In other words, the outdoor side control unit 26, the indoor side control units 36*a* to 36*c* and the transmission line 51 connecting each of the control units form a control section 5 for controlling the entire operation of the air conditioning apparatus 1.

The elements of the control section 5 are connected so as to be capable of receiving detection signals from a variety of sensors (not illustrated in the figure) and so as to be capable of controlling the various devices 21, 24, 31*a* to 31*c*, and 34*a* to 34*c*, and valves V1, V2, V6*a* to V6*c*, and V7*a* to V7*c*, respectively, based on the detection signals and the like.

(2) Indoor Unit

The indoor units 3*a* to 3*c* are installed by being embedded in or hanged down from the ceiling or by being hung on the wall of the inside of a building and the like. The indoor units 3*a* to 3*c* are connected to the outdoor unit 2 through the refrigerant communication pipe 4. The indoor units 3*a* to 3*c* form a part of the refrigerant circuit 10.

Next, a configuration of the indoor units 3*a* to 3*c* will be explained. Note that the indoor unit 3*a* and the other indoor units 3*b* and 3*c* have the same configurations. Accordingly, only the configuration of the indoor unit 3*a* will be hereinafter explained. Explanation of the configurations of the indoor units 3*b* and 3*c* will be omitted by assigning reference numerals of "Xb" and "Xc" to elements of the indoor units 3*b* and 3*c* instead of assigning reference numeral of "Xa" corresponding to each of the elements of the indoor unit 3*a*. For example, the indoor fan 34*a* of the indoor unit 3*a* corresponds to the indoor fans 34*b* and 34*c* of the indoor units 3*b* and 3*c*.

The indoor unit 3*a* mainly includes an indoor side refrigerant circuit 30*a*. The indoor side refrigerant circuit 30*a* forms a part of the refrigerant circuit 10. The indoor side refrigerant circuit 30*a* mainly includes an indoor compressor 31*a*, an indoor four-way switch valve V6*a*, an indoor expansion valve V7*a* functioning as an expansion mechanism, and an indoor heat exchanger 33*a* functioning as a utilization side heat exchanger.

The indoor compressor 31*a* is a compressor capable of changing its operation capacity. In the present embodiment, the indoor compressor 31*a* is a positive-displacement compressor to be driven by a motor 32*a*. Rotation speed of the motor 32*a* is controlled by an inverter. The indoor compressor 31*a* is configured to function as a compressor on the lower stage of the two-stage compression two-stage expansion refrigeration cycle in the cooling operation. On the other hand, it is configured to function as a compressor on the higher stage of the two-stage compression two-stage expansion refrigeration cycle in the heating operation. The indoor compressor 31*a* is capable of controlling its operation capacity depending on operation load to be applied in air-conditioning of the indoor space. In the present embodiment, the air conditioning apparatus 1 includes three indoor units 3*a* to 3*c*. The indoor units 3*a* to 3*c* are configured to control operational capacities of the indoor compressors 31*a* to 31*c* provided therein, respectively, depending on operation loads of the indoor units 3*a* to 3*c* to be applied in air-conditioning of their corresponding indoor spaces.

The indoor four-way switch valve V6*a* is a valve provided for causing the indoor heat exchanger 33*a* to function as an evaporator and a condenser. In this regard, the indoor four-way switch valve V6*a* is similar to the outdoor four-way switch valve V1. The indoor four-way switch valve V6*a* is connected to the indoor heat exchanger 33*a*, a suction side of the indoor compressor 31*a*, a discharge side of the indoor compressor 31*a* and the gas refrigerant communication pipe 42. When the indoor heat exchanger 33*a* is caused to function as a condenser, the indoor four-way switch valve V6*a* is configured to connect the discharge side of the indoor compressor 31*a* and the indoor heat exchanger 33*a*, and is also configured to connect the suction side of the indoor compressor 31*a* and the gas refrigerant communication pipe 42 (see the dashed-line condition in FIG. 1). On the other hand, when the indoor heat exchanger 33*a* is caused to function as an evaporator, the indoor four-way switch valve V6*a* is configured to connect the indoor heat exchanger 33*a* and the suction side of the indoor compressor 31*a*, and is also configured to connect the discharge side of the indoor compressor 31*a* and the gas refrigerant communication pipe 42 (see the solid-line condition in FIG. 1). Note that the outdoor four-way switch valve V1 and the indoor four-way switch valve V6*a* are configured to function in conjunction with each other as hereinafter described. When the outdoor four-way switch valve V1 is switched to a condition for causing the outdoor heat exchanger 23 to function as a condenser, the indoor four-way switch valve V6*a* is switched to a condition for causing the indoor heat exchanger 33*a* to function as an evaporator. On the other hand, when the outdoor four-way switch valve V1 is switched to a condition for causing the outdoor heat exchanger 23 to function as an evaporator, the indoor four-way switch valve V6*a* is switched to a condition for causing the indoor heat exchanger 33*a* to function as a condenser.

The indoor expansion valve V7*a* is an electric expansion valve for regulating the pressure, the flow rate and the like of the refrigerant flowing through the indoor side refrigerant circuit 30*a*. The indoor expansion valve V7*a* is connected to the liquid side of the indoor heat exchanger 33*a*. In this regard, the indoor expansion valve V7*a* is similar to the outdoor expansion valve V2. The indoor expansion valve V7*a* is configured to function as a second-stage expansion mechanism of the second-stage compression second-stage expansion refrigeration cycle in the cooling operation. On the other hand, it is configured to function as a first-stage expansion mechanism of the second-stage compression second-stage expansion refrigeration cycle in the heating operation. When the indoor expansion valve V7*a* functions as the first-stage expansion mechanism, it decompresses the refrigerant of the high pressure Ph to the intermediate pressure Pm. On the other hand, when the indoor expansion valve V7*a* functions as the second-stage expansion mechanism, it decompresses the refrigerant of the intermediate pressure Pm to the low pressure Pl. In this regard, the indoor expansion valve V7*a* is also similar to the outdoor expansion valve V2.

The indoor heat exchanger 33*a* is a cross-fin typed fin-and-tube heat exchanger formed by a heat transmission tube and a plurality of fins. The indoor heat exchanger 33*a* is configured to function as an evaporator of the refrigerant for cooling the indoor air in the cooling operation. On the other hand, it is configured to function as a condenser of the refrigerant for heating the indoor air in the heating operation.

Furthermore, the indoor unit 3*a* includes the indoor fan 34*a*. The indoor fan 34*a* functions as a ventilation fan for sucking indoor air into the indoor unit 3*a* and subsequently causing the sucked air to exchange heat with the refrigerant in the indoor heat exchanger 33*a* and thereafter supplying it as the supply air. The indoor fan 34*a* is capable of changing the flow rate of air to be supplied to the indoor heat exchanger 33*a*. In the present embodiment, the indoor fan 34*a* may be a centrifugal fan, a multi-blade fan and the like to be driven by a motor 35*a*. The motor 35*a* is composed of a DC fan motor.

Moreover, the indoor unit 3*a* is provided with the indoor side control unit 36*a* for controlling operations of each of the elements forming the indoor unit 3*a*. The indoor side control unit 36*a* includes a microcomputer, a memory and the like provided for controlling the indoor unit 3*a*. The indoor side control unit 36*a* is capable of transmitting/receiving a control signal and the like to/from a remote controller (not illustrated in the figure) for controlling the indoor unit 3*a* independently from the other indoor units. Additionally, the indoor side control unit 36*a* is capable of transmitting/receiving a control signal and the like to/from the outdoor unit 2 through the transmission line 51.

(3) Refrigerant Communication Pipe

When the air conditioning apparatus 1 is installed in an installation place of a building and the like, the refrigerant communication pipe 4 is attached to the air conditioning apparatus 1 in the installation site. Any suitable refrigerant communication pipes 4 of a variety of lengths and diameters may be used depending on installation conditions (e.g., an installation site and a combination of the outdoor unit 2 and the indoor units 3*a* to 3*c*).

<Operation of Air Conditioning Apparatus>

Next, operations of the air conditioning apparatus 1 of the present embodiment will be explained.

The air conditioning apparatus 1 of the present embodiment is configured to be operated in two operation modes depending on loads of the indoor units 3*a* to 3*c* applied in cooling and heating of the indoor space. One of the operation modes is a cooling operation for causing the indoor units 3*a* to 3*c* to cool the indoor space whereas the other of the operation modes is a heating operation for causing the indoor units 3*a* to 3*c* to heat the indoor space.

Operations of the air conditioning apparatus 1 in each of the operation modes will be hereinafter explained.

(1) Cooling Operation

First, the cooling operation will be explained with reference to FIGS. 1 and 2. In the cooling operation, the outdoor four-way switch valve V1 in the outdoor side refrigerant circuit 20 of the outdoor unit 2 is switched to the solid-line condition in FIG. 1, and the indoor four-way switch valves V6*a* to V6*c* in the indoor side refrigerant circuits 30*a* to 30*c* of the indoor units 3*a* to 3*c* are switched to the solid-line condition in FIG. 1. Accordingly, the outdoor heat exchanger 23 is configured to function as a condenser, and the indoor heat exchangers 33*a* to 33*c* are configured to function as evaporators.

When the indoor compressors 31*a* to 31*c*, the outdoor compressor 21, the outdoor fan 24 and the indoor fans 34*a* to 34*c* are activated under the condition of the refrigerant circuit 10, the gas refrigerant of the low pressure Pl is inhaled into the indoor compressors 31*a* to 31*c*, and is compressed to the intermediate pressure Pm. The compressed gas refrigerant of the intermediate pressure Pm is transported to the gas refrigerant communication pipe 42 via the indoor four-way switch valves V6*a* to V6*c*. After the gas refrigerant of the intermediate pressure Pm is transported to the gas refrigerant communication pipe 42, it flows into the outdoor unit 2 through the gas side stop valve V4. After the gas refrigerant flows into the outdoor unit 2, it merges with the gas refrigerant (i.e., injection gas) flowing from the gas liquid separator 27 via the bypass circuit 28. Here, the injection gas is separated from the gas-liquid two-phase state refrigerant by the gas liquid separator 27. Then the merged gas refrigerant flows into the outdoor compressor 21 via the outdoor four-way switch valve V1. After the gas refrigerant flows into the outdoor compressor 21, it is compressed from the intermediate pressure Pm to the high pressure Ph, and further flows into the outdoor heat exchanger 23. At this point, the outdoor heat exchanger 23 functions as a condenser, and cools the refrigerant by releasing heat of the refrigerant into the outdoor air to be supplied by the outdoor fan 24. Subsequently, the outdoor expansion valve V2 decompresses the refrigerant of the high pressure Ph to the intermediate pressure Pm. The refrigerant decompressed to the intermediate pressure Pm is in a gas-liquid two-phase state, and flows into the gas liquid separator 27. The gas liquid separator 27 separates the refrigerant into the liquid refrigerant and the gas refrigerant. The gas liquid separator 27 discharges the liquid refrigerant of the intermediate pressure Pm to a pipe in the liquid stop valve V3 side, and discharges the gas refrigerant of the intermediate pressure Pm toward the suction side of the outdoor compressor 21 through the bypass circuit 28.

The liquid refrigerant of the intermediate pressure Pm is transported to the indoor units 3*a* to 3*c* via the liquid side stop valve V3 and the liquid refrigerant communication pipe 41. After the liquid refrigerant of the intermediate pressure Pm is transported to the indoor units 3*a* to 3*c*, it is decompressed to approximately the intake pressure of the indoor compressors 31*a* to 31*c* by the indoor expansion valves V7*a* to V7*c*. Accordingly, the liquid refrigerant changes into gas-liquid two-phase state refrigerant of the low pressure Pl, and is transported to the indoor heat exchangers 33*a* to 33*c*. Subsequently, the indoor heat exchangers 33*a* to 33*c* conduct heat exchange between the refrigerant and the indoor air. The refrigerant evaporates and changes into gas refrigerant of the low pressure Pl. The gas refrigerant of the low pressure Pl is again inhaled into the indoor compressors 31*a* to 31*c* via the indoor four-way switch valves V6*a* to V6*c*.

(2) Heating Operation

In the heating operation, the outdoor four-way switch valve V1 in the outdoor side refrigerant circuit 20 of the outdoor unit 2 is switched to the dashed-line condition in FIG. 1, and the indoor four-way switch valves V6*a* to V6*c* in the indoor side refrigerant circuits 30*a* to 30*c* of the indoor units 3*a* to 3*c* are switched to the dashed-line condition in FIG. 1. Accordingly, the outdoor heat exchanger 23 is configured to function as an evaporator whereas the indoor heat exchangers 33*a* to 33*c* are configured to function as condensers.

When the indoor compressors 31*a* to 31*c*, the outdoor compressor 21, the outdoor fan 24 and the indoor fans 34*a* to 34*c* are activated under the condition of the refrigerant circuit 10, gas refrigerant of the low pressure Pl is inhaled into the outdoor compressor 21 and is compressed therein. The gas refrigerant of the low pressure Pl accordingly changes into gas refrigerant of the intermediate pressure Pm. Then, the gas refrigerant of the intermediate pressure Pm flows through the outdoor four-way switch valve V1, and merges with the gas refrigerant (i.e., injection gas) flowing from the gas liquid separator 27 via the bypass circuit 28. Here, the injection gas is separated from the gas-liquid two-phase state refrigerant by the gas liquid separator 27. The merged gas refrigerant of the intermediate pressure Pm is transported to the gas refrigerant communication pipe 42 via the gas side stop valve V4.

After the gas refrigerant of the intermediate pressure Pm is transported to the gas refrigerant communication pipe 42, it is further transported to the indoor units 3*a* to 3*c*. The gas refrigerant of the intermediate pressure Pm transported to the indoor units 3*a* to 3*c* is compressed by the indoor compressors 31*a* to 31*c* to a supercritical state of high temperature and high pressure. The refrigerant of a supercritical state is transported to the indoor heat exchangers 33*a* to 33*c* via the indoor four-way switch valves V6*a* to V6*c*. The indoor heat exchangers 33*a* to 33*c* conduct heat exchange between the refrigerant and the indoor air. Accordingly, the refrigerant is condensed and changes into liquid refrigerant of the high pressure Ph. Subsequently, when the liquid refrigerant of the high pressure Ph passes through the indoor expansion valves V7*a* to V7*c*, it is decompressed to the intermediate pressure Pm in accordance with the degree of opening of the indoor expansion valves V7*a* to V7*c*.

After the refrigerant passes through the indoor expansion valves V7*a* to V7*c*, it is transported to the outdoor unit 2 via the liquid refrigerant communication pipe 41. The refrigerant of the intermediate pressure Pm flows into the outdoor unit 2 via the liquid side stop valve V3. Here, the refrigerant of the intermediate pressure Pm is in a gas-liquid two-phase state, and flows into the gas liquid separator 27. The gas liquid separator 27 separates the refrigerant into the liquid refrigerant and the gas refrigerant. The gas liquid separator 27 discharges the liquid refrigerant of the intermediate pressure Pm to a pipe in the outdoor expansion valve V2 side whereas it discharges the gas refrigerant of the intermediate pressure Pm toward the suction side of the outdoor compressor 21 via the bypass circuit 28. The liquid refrigerant of the intermediate pressure Pm is further decompressed to the low pressure Pl through the outdoor expansion valve V2. The liquid refrigerant of the low pressure Pl thereafter flows into the outdoor heat exchanger 23. Here, the refrigerant of the low pressure Pl flowing into the outdoor heat exchanger 23 is in a gas-liquid two-phase state, and evaporates in the course of heat exchange with the outdoor air to be supplied by the outdoor fan 24. Accordingly, the refrigerant changes into gas refrigerant of the low pressure Pl. The gas refrigerant is again inhaled into the outdoor compressor 21 via the outdoor four-way switch valve V1.

<Two-Stage Compression Two-Stage Expansion Refrigeration Cycle>

Figure 2:
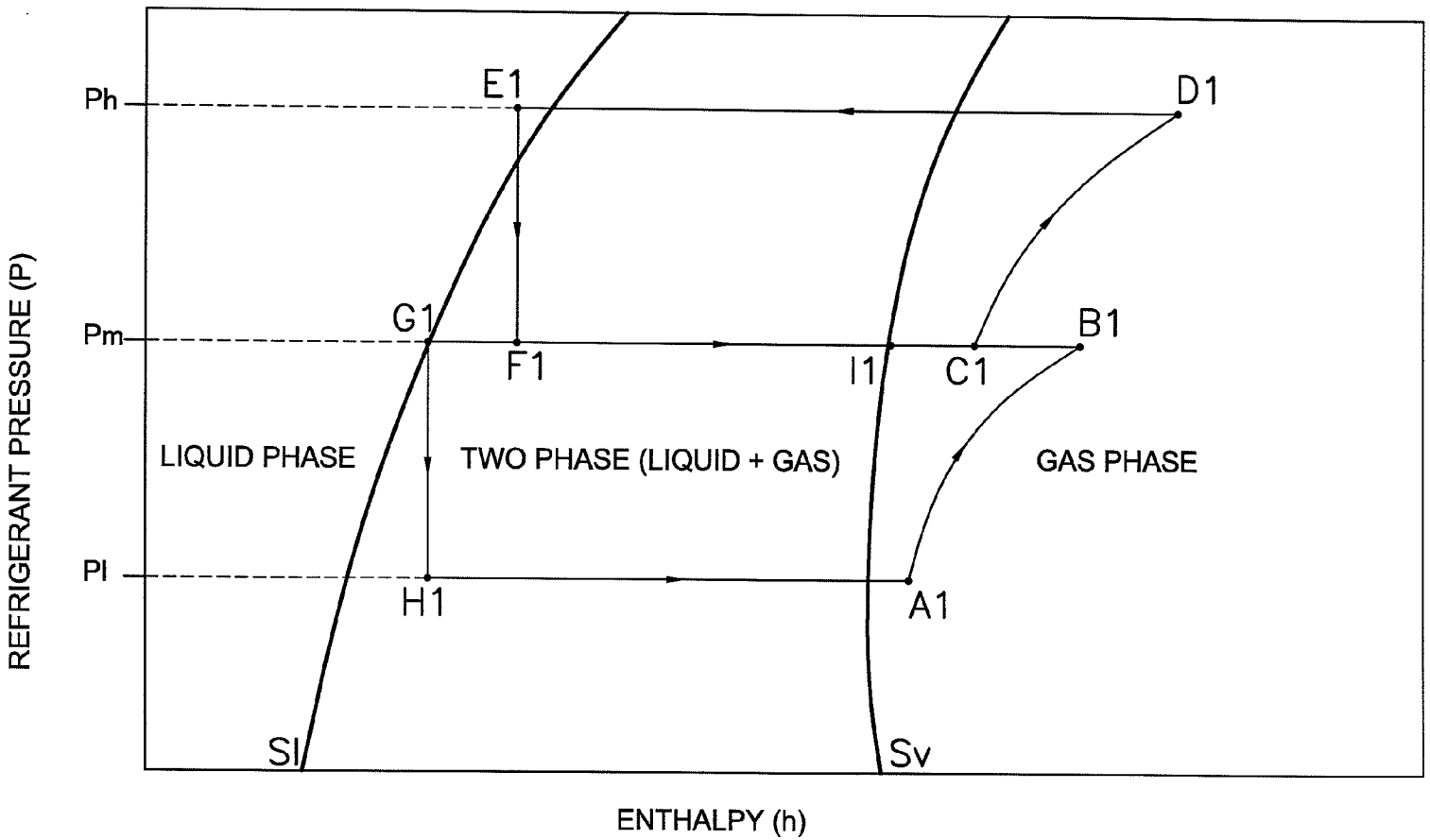
FIG. 2 is a P-H chart for illustrating a two-stage compression two-stage expansion refrigeration cycle using carbon dioxide ($CO_2$) refrigerant in the air conditioning apparatus of the present invention.

FIG. 2 illustrates the refrigeration cycle under the supercritical condition with P-H chart (Mollier diagram). In the present invention, the $CO_2$ refrigerant (i.e., the supercritical refrigerant) is used as refrigerant. Moreover, the present invention adopts the two-stage compression two-stage expansion refrigeration cycle configured to compress the refrigerant in two stages with two compressors provided in one system in the refrigerant circuit 10, and is configured to expand the refrigerant in two stages with two expansion mechanisms provided in one system in the refrigerant circuit 10. The two-stage compression two-stage expansion cycle will be explained with reference to FIGS. 1 and 2. The following is an explanation of the two-stage compression two-stage expansion cycle in the aforementioned cooling operation. As described above, the refrigerant circuit 10 is mainly composed of the indoor compressors 31*a* to 31*c*, the outdoor compressor 21, the outdoor heat exchanger 23, the outdoor expansion valve V2, the indoor expansion valves V7*a* to V7*c* and the indoor heat exchangers 33*a* to 33*c*. Points A1, B1, C1, D1, E1, F1, G1, H1 and I1 in FIG. 2 illustrate states of the refrigerant at the corresponding points in FIG. 1, respectively.

In the refrigerant circuit 10, the indoor compressors 31*a* to 31*c* compress the refrigerant and the compressed refrigerant changes into high-temperature refrigerant of the intermediate pressure Pm (A1→B1). The high temperature refrigerant compressed to the intermediate pressure Pm passes through the gas refrigerant communication pipe 42 without changing the intermediate pressure Pm, and merges with the gas refrigerant (i.e., injection gas) of the intermediate pressure Pm separated from the gas-liquid two-phase state refrigerant by the gas liquid separator 27. Accordingly, the high temperature refrigerant of the intermediate pressure Pm is cooled (B1+I1→C1). The outdoor compressor 21 compresses the gas refrigerant of the intermediate pressure Pm cooled by merging with the injection gas. The gas refrigerant of the intermediate pressure Pm changes into high-temperature refrigerant of the high pressure Ph (C1→D1). At this time, the gas refrigerant, $CO_2$, enters a supercritical state. Note the term "supercritical state" herein means a state of material under temperature and pressure equal to or greater than the critical point K. The supercritical state has both gas diffusivity and liquid solubility. In FIG. 2, the supercritical state of the refrigerant is shown in the area positioned rightward of a critical temperature isothermal curve Tk (not shown) at the critical pressure Pk (not shown) or greater. When the refrigerant (material) enters a supercritical state, there is no distinction between gas phase and liquid phase. Additionally, the term "gas phase" is a state of the refrigerant shown by the area positioned rightward of a saturated vapor curve Sv at the critical pressure Pk or less. On the other hand, the term "liquid phase" is a state of the refrigerant shown by the area positioned leftward of both a saturated liquid curve S1 and the critical temperature isothermal curve Tk. Then, the outdoor heat exchanger 23 functioning as a condenser releases heat of the supercritical refrigerant of high temperature and high pressure compressed by the outdoor compressor 21. Accordingly, the supercritical refrigerant changes into low-temperature refrigerant of the high pressure Ph (D1→E1). At this time, the refrigerant is in a supercritical state. Therefore, the refrigerant operates with sensible heat change (i.e., temperature change) in the interior of the outdoor heat exchanger 23. After the outdoor heat exchanger 23 releases heat of the refrigerant, the refrigerant is expanded in conjunction with opening of the outdoor expansion valve V2. Accordingly, the refrigerant is decompressed from the high pressure Ph to the intermediate pressure Pm (E1→F1). At this time, the refrigerant decompressed by the outdoor expansion valve V2 is in a gas-liquid two-phase state, and flows into the gas liquid separator 27. The gas liquid separator 27 separates the refrigerant into the liquid refrigerant and the gas refrigerant. Then, the gas liquid separator 27 flows the liquid refrigerant of the intermediate pressure Pm into a pipe in the liquid stop valve V3 side is attached (F1→G1) whereas it flows the gas refrigerant of the intermediate pressure Pm toward the suction side of the outdoor compressor 21 through the bypass circuit 28 (F1→I1). The liquid refrigerant of the intermediate pressure Pm passes through the liquid refrigerant communication pipe 41, and is further expanded by the indoor expansion valves V7*a* to V7*c*. Accordingly, the refrigerant changes into liquid refrigerant of the low pressure Pl (G1→H1). The liquid refrigerant of the low pressure Pl absorbs heat and evaporates in the indoor heat exchangers 33*a* to 33*c*, and returns to the indoor compressors 31*a* to 31*c* (H1→A1).

<Characteristics>

(1)

The air conditioning apparatus 1 of the present embodiment is provided with a plurality of the indoor units (three indoor units 3*a* to 3*c* in the present embodiment). With the structure, not only the outdoor unit 2 but also the indoor units 3*a* to 3*c* are provided with the indoor compressors 31*a* to 31*c*, respectively. The indoor compressors 31*a* to 31*c* are capacity variable compressors allowed to be controlled by an inverter. Furthermore, the control section 5 controls the indoor compressors 31*a* to 31*c* in accordance with the operation loads of the indoor units 3*a* to 3*c*, respectively.

Therefore, the air conditioning apparatus 1 allows each of the indoor units 3*a* to 3*c* to independently control both the evaporation temperature of the refrigerant in the cooling operation and the high pressure of the refrigerant in the heating operation. In other words, the air conditioning apparatus 1 is capable of accurately controlling capacities of the indoor units 3*a* to 3*c* in accordance with their operation loads, respectively. Accordingly, the air conditioning apparatus 1 is capable of enhancing its operational efficiency and saving energy.

(2)

The air conditioning apparatus 1 of the present embodiment is provided with the outdoor four-way switch valve V1 and the indoor four-way switch valves V6*a* to V6*c* capable of switching the operational modes between the cooling operation and the heating operation. Specifically, the outdoor unit 2 is provided with the outdoor four-way switch valve V1 while the indoor units 3*a* to 3*c* are provided with the indoor four-way switch valves V6*a* to V6*c*, respectively.

With the structure, the air conditioning apparatus 1 is capable of switching usage modes of the indoor heat exchangers 33*a* to 33*c* and the outdoor heat exchanger 23. Specifically, in one mode, the indoor heat exchangers 33*a* to 33*c* are used as gas coolers while the outdoor heat exchanger 23 is used as an evaporator. In the other mode, the indoor heat exchangers 33*a* to 33*c* are used as evaporators while the outdoor heat exchanger 23 is used as a gas cooler. Thus, the air conditioning apparatus 1 is capable of switching the operational modes of the indoor units 3*a* to 3*c* between the cooling operation and the heating operation. Accordingly, the air conditioning apparatus 1 is capable of switching the operational conditions depending on temperature. Consequently, it is capable of providing a comfortable air-conditioned space.

<Modifications>

(1)

Figure 3:
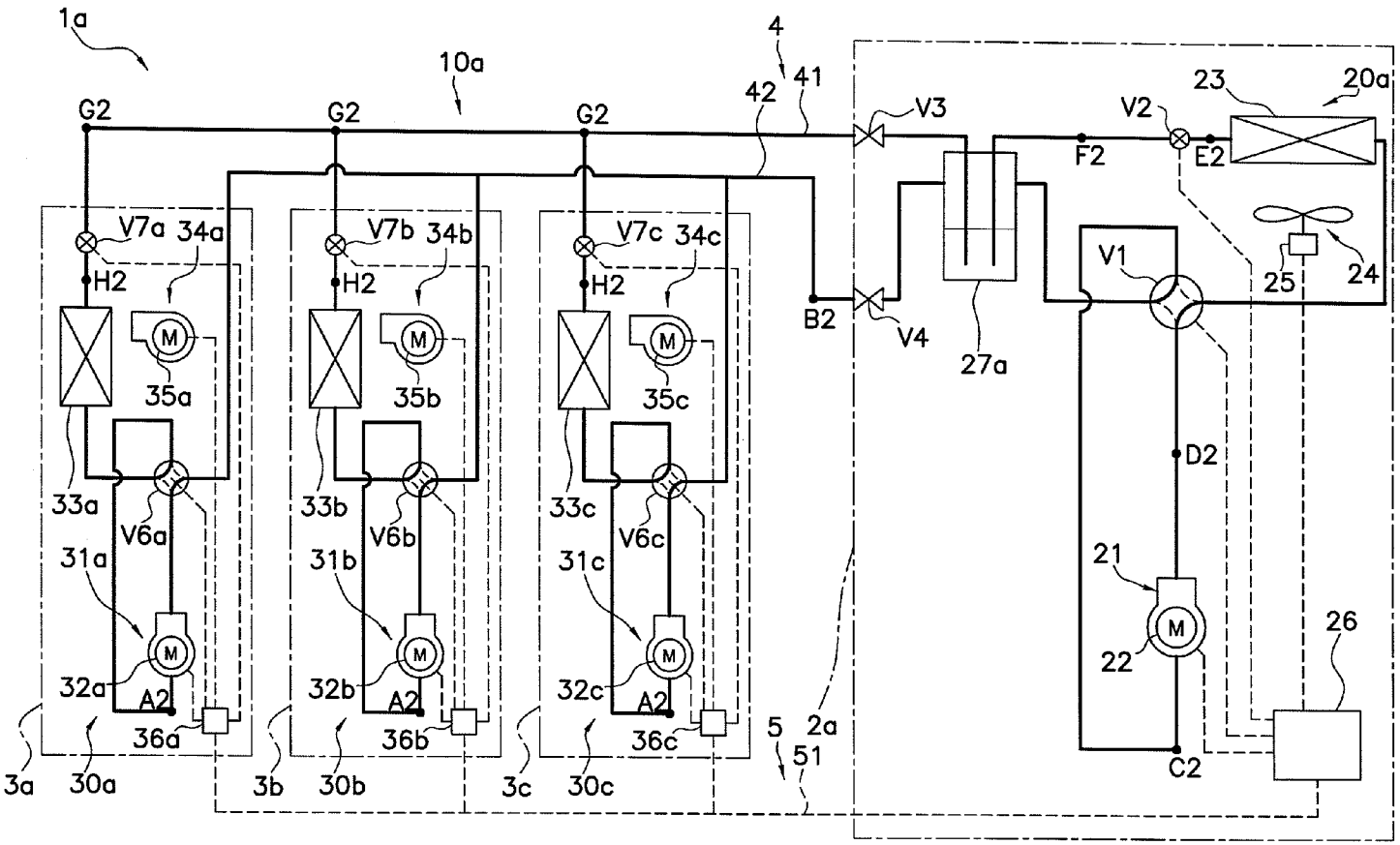
FIG. 3 is a refrigerant circuit diagram of an air conditioning apparatus according to Modification (1).

According to the air conditioning apparatus 1 of the aforementioned embodiment, the refrigerant communication pipe 4 (i.e., the liquid refrigerant communication pipe 41 and the gas refrigerant communication pipe 42) is connected between the outdoor expansion valve V2 and the indoor expansion valves V7*a* to V7*c*, and between the outdoor compressor 21 and the indoor compressors 31*a* to 31*c*, without any intervening devices. However, an intermediate cooler 27*a* may be further provided therebetween. For example, as illustrated in FIG. 3, the intermediate cooler 27*a* may be provided in the outdoor unit 2. A refrigeration cycle in a refrigerant circuit 10*a* having the intermediate cooler 27*a* will be hereinafter explained.

Figure 4:
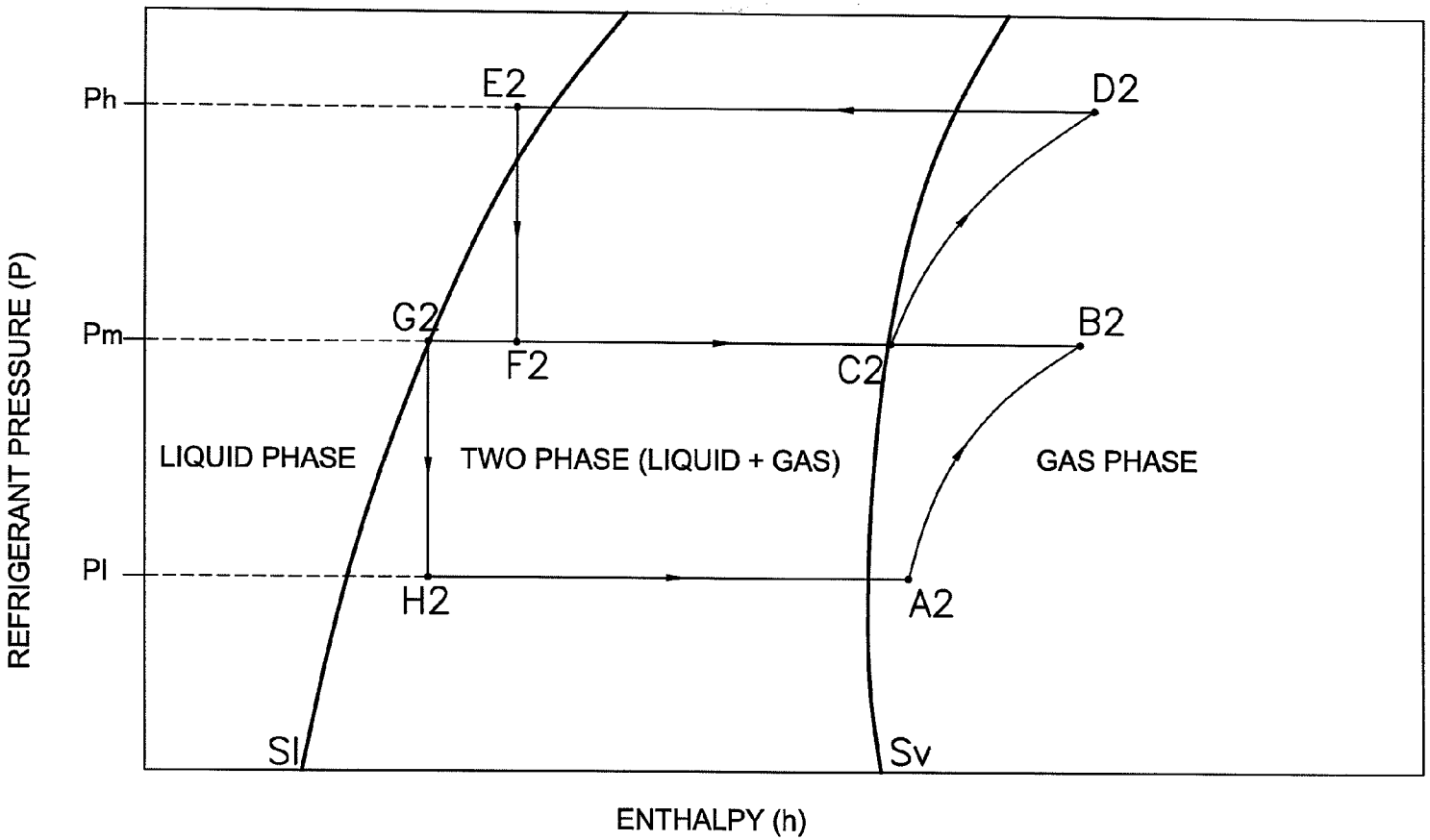
FIG. 4 is a P-H chart for illustrating a two-stage compression two-stage expansion refrigeration cycle using the $CO_2$ refrigerant in the air conditioning apparatus according to Modification (1).

FIG. 4 illustrates a refrigeration cycle under a supercritical condition with a P-H chart (Mollier diagram). In the present invention, the $CO_2$ refrigerant (i.e., the supercritical refrigerant) is used as refrigerant. Furthermore, the air conditioning apparatus of the present modification adopts the two-stage compression two-stage expansion refrigeration cycle for compressing the refrigerant in two stages with two compressors and expanding the refrigerant in two stages with two expansion mechanisms. The two-stage compression two-stage expansion cycle will be explained with reference to FIGS. 3 and 4. The following is an explanation of the two-stage compression two-stage expansion cycle in the aforementioned cooling operation. The refrigerant circuit 10*a* is mainly composed of indoor compressors 31*a* to 31*c*, an outdoor compressor 21, an outdoor heat exchanger 23, an outdoor expansion valve V2, the intermediate cooler 27*a*, indoor expansion valves V7*a* to V7*c* and indoor heat exchangers 33*a* to 33*c*. Points A2, B2, C2, D2, E2, F2, G2 and H2 in FIG. 3 illustrate states of the refrigerant at each of the corresponding points in FIG. 4. Note an operational condition of this case will be explained with the cooling operation.

In the refrigerant circuit 10*a*, the indoor compressors 31*a* to 31*c* compress the refrigerant, and the compressed refrigerant changes into high-temperature refrigerant of the intermediate pressure Pm (A2→B2). The high-temperature refrigerant compressed to the intermediate pressure Pm flows into the intermediate cooler 27*a*. Additionally, the liquid refrigerant, decompressed to the intermediate pressure Pm by the outdoor expansion valve V2, flows into the intermediate cooler 27*a*. In the intermediate cooler 27*a*, the liquid refrigerant and the gas refrigerant compressed in the indoor compressors 31*a* to 31*c* coexist in equilibrium. The gas refrigerant of a superheating state is cooled to exactly or approximately a saturated state. Thus superheat of the refrigerant is eliminated (B2→C2). After the intermediate cooler 27*a* eliminates superheat of the gas refrigerant, the outdoor compressor 21 compresses the gas refrigerant. Accordingly, the gas refrigerant changes into high-temperature refrigerant of the high pressure Ph (C2→D2). At this time, the gas refrigerant, $CO_2$, enters a supercritical state. Then, the outdoor heat exchanger 23 functioning as a condenser releases heat of the high-temperature supercritical refrigerant of the high pressure Ph produced by the compression of the outdoor compressor 21. Accordingly, the refrigerant changes into low-temperature refrigerant of the high pressure Ph (D2→E2). At this time, the refrigerant is in a supercritical state. Therefore, the refrigerant operates with the sensible heat change (i.e., temperature change) in the interior of the outdoor heat exchanger 23. After the outdoor heat exchanger 23 releases heat of the refrigerant, the refrigerant expands in conjunction with opening of the outdoor expansion valve V2. Accordingly, the refrigerant of the high pressure Ph is decompressed to the intermediate pressure Pm (E2→F2). Then, the refrigerant decompressed by the outdoor expansion valve V2 flows into the intermediate cooler 27*a*. Part of the refrigerant of the intermediate pressure Pm, having flown into the intermediate cooler 27*a*, evaporates (F2→C2). The liquid refrigerant in the interior of the intermediate cooler 27*a* is thereby cooled to the subcooling zone (F2→G2). At this time, elimination of superheat of the gas refrigerant, conducted in the aforementioned processing "B2→C2", is also simultaneously conducted. The liquid refrigerant of the intermediate pressure Pm remaining in the intermediate cooler 27*a* is further expanded by the indoor expansion valves V7*a* to V7*c*, and changes into liquid refrigerant of the low pressure Pl (G2→H2). The liquid refrigerant of the low pressure Pl absorbs heat and evaporates in the indoor heat exchangers 33*a* to 33*c*, and returns to the indoor compressors 31*a* to 31*c* (H2→A2).

According to the present invention, the outdoor unit 2*a* is provided with the intermediate cooler 27*a* for cooling both the liquid refrigerant of the intermediate pressure Pm and the gas refrigerant of the intermediate pressure Pm. Both the gas-liquid two-phase state refrigerant, expanded to the intermediate pressure Pm by the outdoor expansion valve V2, and the gas refrigerant, compressed to the intermediate pressure Pm by the indoor compressors 31*a* to 31*c*, pass through the intermediate cooler 27*a*. Here, part of the liquid refrigerant evaporates, and a refrigeration effect is accordingly applied to the refrigerant in the interior of the intermediate cooler 27*a*.

Therefore, it is possible to cool the gas refrigerant of the intermediate pressure Pm compressed by the indoor compressors 31*a* to 31*c* to exactly or approximately a saturated state. Furthermore, it is similarly possible to cool the liquid refrigerant to the subcooling zone by means of the refrigeration effect. Consequently, it is possible to enhance the refrigeration effect in the entire cycle. Furthermore, it is possible to reduce discharge temperature of the outdoor compressor 21 and prevent deterioration of lubricant oil of the outdoor compressor 21. In the aforementioned explanation, only the working effects of the present modification in the cooling operation are described. However, the present modification also achieves similar working effects in the heating operation.

(2)

Figure 5:
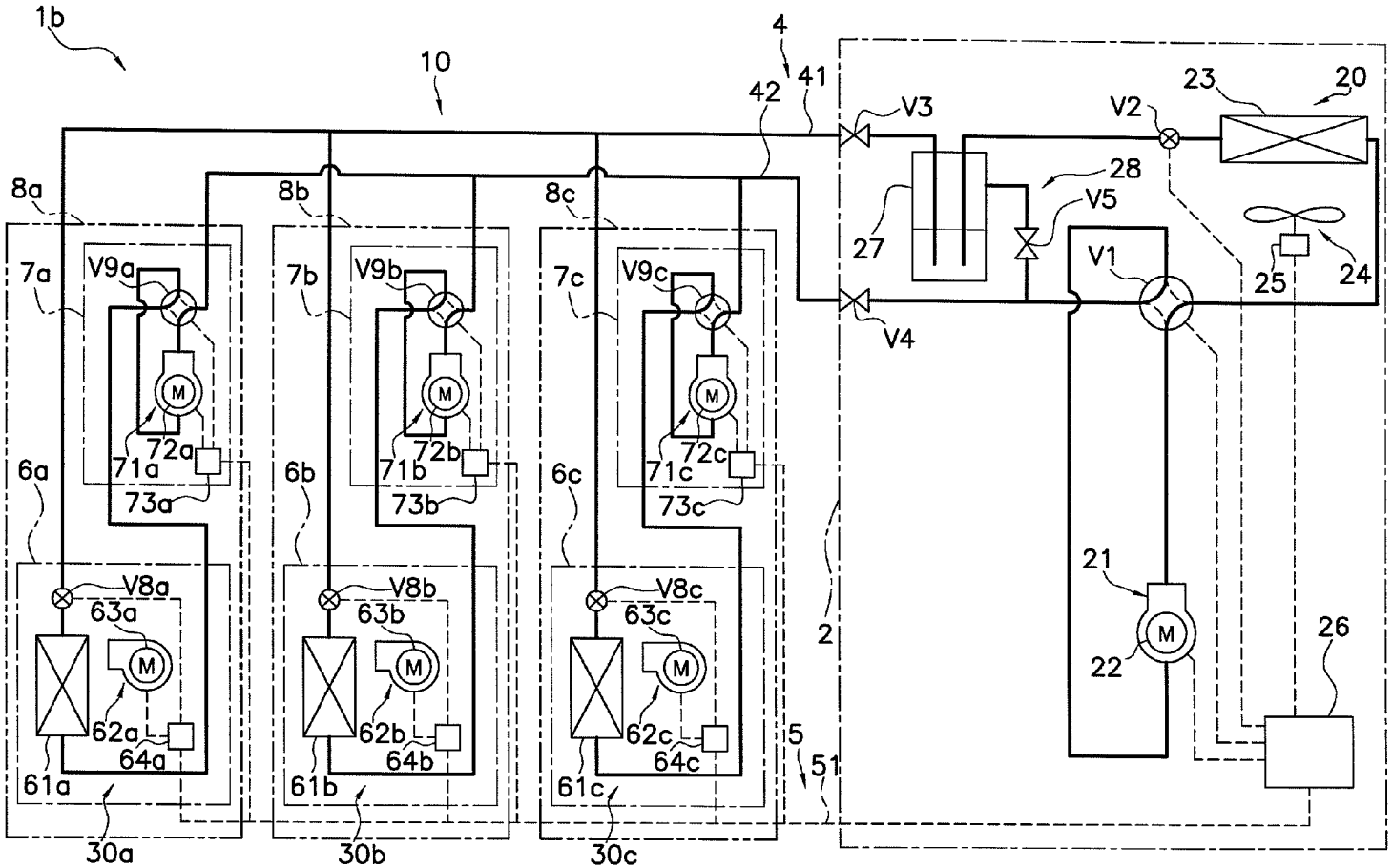
FIG. 5 is a refrigerant circuit diagram of an air conditioning apparatus according to Modification (2).

According to the air conditioning apparatus 1 of the present embodiment, three indoor units 3*a* to 3*c* are provided with the indoor compressors 31*a* to 31*c*, respectively. However, the present invention is not limited to the structure. For example, as illustrated in FIG. 5, three indoor units 8*a* to 8*c* may be composed of heat exchange sections 6*a* to 6*c* and compressor sections 7*a* to 7*c*.

Each of the heat exchange sections 6*a* to 6*c* is composed of an indoor heat exchanger (61*a*/61*b*/61*c*), an indoor fan (62*a*/62*b*/62*c*) to be driven by a motor (63*a*/63*b*/63*c*), an indoor expansion valve (V8*a*/V8*b*/V8*c*), and a heat exchanger side control unit (64*a*/64*b*/64*c*). On the other hand, each of the compressor sections 7*a* to 7*c* is composed of an indoor compressor (71*a*/71*b*/71*c*) to be driven by a motor (72*a*/72*b*/72*c*), an indoor four-way switch valve (V9*a*/V9*b*/V9*c*) and a compressor side control unit (73*a*/73*b*/73*c*). The compressor side control units 73*a* to 73*c* are connected to a transmission line 51, and each of them is configured to control the indoor compressor (71*a*/71*b*/71*c*) in the compressor section (7*a*/7*b*/7*c*) and the indoor four-way switch valve (V9*a*/V9*b*/V9*c*). In this case, the heat exchange sections 6*a* to 6*c* correspond to indoor units in the conventional art.

In this case, each of the indoor units 8*a*, 8*b* and 8*c* is formed by the combination of the compressor section (7*a*/7*b*/7*c*) and the heat exchange section (6*a*/6*b*/6*c*). Accordingly, when predetermined indoor units without any compressors have been already installed, it is possible to effectively operate each of the indoor units by newly attaching the compressor sections 7*a* to 7*c* to them.

(3)

In the air conditioning apparatus 1 of the present embodiment, the outdoor unit 2 is provided with the outdoor expansion valve V2 as an expansion mechanism while the indoor unit 3 is provided with the indoor expansion valve V7 as an expansion mechanism. However, the expansion mechanisms are not limited to them. For example, the outdoor unit 2 and the indoor unit 3 may be provided with any suitable expansion devices, respectively.

INDUSTRIAL APPLICABILITY

The air conditioning apparatus of the present invention is capable of reducing cost necessary for update/renewal construction of an already-installed air conditioning apparatus because an already-disposed refrigerant communication pipe is allowed to be used without any changes. Additionally, the air conditioning apparatus is useful for a variety of apparatuses including an air conditioning apparatus required to have high design pressure (e.g., an air conditioning apparatus configured to operate with the $CO_2$ refrigerant and the like).

What is claimed is:

1. An air conditioning apparatus for conducting air conditioning by changing a state of a refrigerant, comprising:

a heat source unit including a heat source side compressor configured to compress the refrigerant, a heat source side heat exchanger configured to conduct heat exchange of the refrigerant, and a heat source side expansion mechanism configured to decompress the refrigerant;

a first utilization unit including a first utilization side compressor configured to compress the refrigerant, a first utilization side heat exchanger configured to conduct heat exchange of the refrigerant, and a first utilization side expansion mechanism configured to decompress the refrigerant;

a second utilization unit including a second utilization side compressor configured to compress the refrigerant, a second utilization side heat exchanger configured to conduct heat exchange of the refrigerant, and a second utilization side expansion mechanism configured to decompress the refrigerant;

a refrigerant communication pipe arranged to connect the heat source unit and the first and second utilization units; and a control section configured to control the first utilization side compressor and the first utilization side expansion mechanism in accordance with an operation load of the first utilization unit and configured to control the second utilization side compressor and the second utilization side expansion mechanism in accordance with an operation load of the second utilization unit.

2. The air conditioning apparatus according to claim 1, wherein the first utilization side compressor and the second utilization side compressor are controllable by an inverter.

3. The air conditioning apparatus according to claim 2, wherein the heat source unit further includes an intermediate cooler.

4. The air conditioning apparatus according to claim 3, wherein the heat source unit further includes a heat source side switch mechanism configured to be switchable between a first condition and a second condition, the first condition causes refrigerant compressed to intermediate pressure by the first utilization side compressor or the second utilization side compressor to flow into the heat source side compressor and causes refrigerant compressed to high pressure by the heat source side compressor to flow into the heat source side heat exchanger, the second condition causes low-pressure refrigerant evaporated by the heat source side heat exchanger to flow into the heat source side compressor and causes refrigerant compressed to intermediate pressure by the heat source side compressor to flow into the first utilization side compressor or the second utilization side compressor, the first utilization unit further includes a first utilization side switch mechanism configured to be switchable between a third condition and a fourth condition, the third condition causes low-pressure refrigerant evaporated by the first utilization side heat exchanger to flow into the first utilization side compressor and causes refrigerant compressed to intermediate pressure by the first utilization side compressor to flow into the heat source side compressor, the fourth condition causes refrigerant compressed to intermediate pressure by the heat source side compressor to flow into the first utilization side compressor and causes refrigerant compressed to high pressure by the first utilization side compressor to flow into the first utilization side heat exchanger, the second utilization unit further includes a second utilization side switch mechanism configured to be switchable between a fifth condition and a sixth condition, the fifth condition causes low-pressure refrigerant evaporated by the second utilization side heat exchanger to flow into the second utilization side compressor and causes refrigerant compressed to intermediate pressure by the second utilization side compressor to flow into the heat source side compressor, the sixth condition causes refrigerant compressed to intermediate pressure by the heat source side compressor to flow into the second utilization side compressor and causes refrigerant compressed to high pressure by the second utilization side compressor to flow into the first utilization side heat exchanger, and the control section being further configured to conduct a first control and a second control, the first control sets the heat source side switch mechanism, the first utilization side switch mechanism and the second utilization side switch mechanism to be in the first condition, the third condition and the fifth condition, respectively, the second control sets the heat source side switch mechanism, the first utilization side switch mechanism and the second utilization side switch mechanism to be in the second condition, the fourth condition and the sixth condition, respectively.

5. The air conditioning apparatus according to claim 2, wherein the heat source unit further includes a heat source side switch mechanism configured to be switchable between a first condition and a second condition, the first condition causes refrigerant compressed to intermediate pressure by the first utilization side compressor or the second utilization side compressor to flow into the heat source side compressor and causes refrigerant compressed to high pressure by the heat source side compressor to flow into the heat source side heat exchanger, the second condition causes low-pressure refrigerant evaporated by the heat source side heat exchanger to flow into the heat source side compressor and causes refrigerant compressed to intermediate pressure by the heat source side compressor to flow into the first utilization side compressor or the second utilization side compressor, the first utilization unit further includes a first utilization side switch mechanism configured to be switchable between a third condition and a fourth condition, the third condition causes low-pressure refrigerant evaporated by the first utilization side heat exchanger to flow into the first utilization side compressor and causes refrigerant compressed to intermediate pressure by the first utilization side compressor to flow into the heat source side compressor, the fourth condition causes refrigerant compressed to intermediate pressure by the heat source side compressor to flow into the first utilization side compressor and causes refrigerant compressed to high pressure by the first utilization side compressor to flow into the first utilization side heat exchanger, the second utilization unit further includes a second utilization side switch mechanism configured to be switchable between a fifth condition and a sixth condition, the fifth condition causes low-pressure refrigerant evaporated by the second utilization side heat exchanger to flow into the second utilization side compressor and causes refrigerant compressed to intermediate pressure by the second utilization side compressor to flow into the heat source side compressor, the sixth condition causes refrigerant compressed to intermediate pressure by the heat source side compressor to flow into the second utilization side compressor and causes refrigerant compressed to high pressure by the second utilization side compressor to flow into the first utilization side heat exchanger, and the control section being further configured to conduct a first control and a second control, the first control sets the heat source side switch mechanism, the first utilization side switch mechanism and the second utilization side switch mechanism to be in the first condition, the third condition and the fifth condition, respectively, the second control sets the heat source side switch mechanism, the first utilization side switch mechanism and the second utilization side switch mechanism to be in the second condition, the fourth condition and the sixth condition, respectively.

6. The air conditioning apparatus according to claim 1, wherein the heat source unit further includes an intermediate cooler.

7. The air conditioning apparatus according to claim 6, wherein the heat source unit further includes a heat source side switch mechanism configured to be switchable between a first condition and a second condition, the first condition causes refrigerant compressed to intermediate pressure by the first utilization side compressor or the second utilization side compressor to flow into the heat source side compressor and causes refrigerant compressed to high pressure by the heat source side compressor to flow into the heat source side heat exchanger, the second condition causes low-pressure refrigerant evaporated by the heat source side heat exchanger to flow into the heat source side compressor and causes refrigerant compressed to intermediate pressure by the heat source side compressor to flow into the first utilization side compressor or the second utilization side compressor, the first utilization unit further includes a first utilization side switch mechanism configured to be switchable between a third condition and a fourth condition, the third condition causes low-pressure refrigerant evaporated by the first utilization side heat exchanger to flow into the first utilization side compressor and causes refrigerant compressed to intermediate pressure by the first utilization side compressor to flow into the heat source side compressor, the fourth condition causes refrigerant compressed to intermediate pressure by the heat source side compressor to flow into the first utilization side compressor and causes refrigerant compressed to high pressure by the first utilization side compressor to flow into the first utilization side heat exchanger, the second utilization unit further includes a second utilization side switch mechanism configured to be switchable between a fifth condition and a sixth condition, the fifth condition causes low-pressure refrigerant evaporated by the second utilization side heat exchanger to flow into the second utilization side compressor and causes refrigerant compressed to intermediate pressure by the second utilization side compressor to flow into the heat source side compressor, the sixth condition causes refrigerant compressed to intermediate pressure by the heat source side compressor to flow into the second utilization side compressor and causes refrigerant compressed to high pressure by the second utilization side compressor to flow into the first utilization side heat exchanger, and the control section being further configured to conduct a first control and a second control, the first control sets the heat source side switch mechanism, the first utilization side switch mechanism and the second utilization side switch mechanism to be in the first condition, the third condition and the fifth condition, respectively, the second control sets the heat source side switch mechanism, the first utilization side switch mechanism and the second utilization side switch mechanism to be in the second condition, the fourth condition and the sixth condition, respectively.

8. The air conditioning apparatus according to claim 1, wherein the heat source unit further includes a heat source side switch mechanism configured to be switchable between a first condition and a second condition, the first condition causes refrigerant compressed to intermediate pressure by the first utilization side compressor or the second utilization side compressor to flow into the heat source side compressor and causes refrigerant compressed to high pressure by the heat source side compressor to flow into the heat source side heat exchanger, the second condition causes low-pressure refrigerant evaporated by the heat source side heat exchanger to flow into the heat source side compressor and causes refrigerant compressed to intermediate pressure by the heat source side compressor to flow into the first utilization side compressor or the second utilization side compressor, the first utilization unit further includes a first utilization side switch mechanism configured to be switchable between a third condition and a fourth condition, the third condition causes low-pressure refrigerant evaporated by the first utilization side heat exchanger to flow into the first utilization side compressor and causes refrigerant compressed to intermediate pressure by the first utilization side compressor to flow into the heat source side compressor, the fourth condition causes refrigerant compressed to intermediate pressure by the heat source side compressor to flow into the first utilization side compressor and causes refrigerant compressed to high pressure by the first utilization side compressor to flow into the first utilization side heat exchanger, the second utilization unit further includes a second utilization side switch mechanism configured to be switchable between a fifth condition and a sixth condition, the fifth condition causes low-pressure refrigerant evaporated by the second utilization side heat exchanger to flow into the second utilization side compressor and causes refrigerant compressed to intermediate pressure by the second utilization side compressor to flow into the heat source side compressor, the sixth condition causes refrigerant compressed to intermediate pressure by the heat source side compressor to flow into the second utilization side compressor and causes refrigerant compressed to high pressure by the second utilization side compressor to flow into the first utilization side heat exchanger, and the control section being further configured to conduct a first control and a second control, the first control sets the heat source side switch mechanism, the first utilization side switch mechanism and the second utilization side switch mechanism to be in the first condition, the third condition and the fifth condition, respectively, the second control sets the heat source side switch mechanism, the first utilization side switch mechanism and the second utilization side switch mechanism to be in the second condition, the fourth condition and the sixth condition, respectively.

* * * * *